US011174115B2

(12) United States Patent
Okano

(10) Patent No.: US 11,174,115 B2
(45) Date of Patent: Nov. 16, 2021

(54) PAPER FEEDING APPARATUS AND IMAGE FORMING APPARATUS

(71) Applicant: Konica Minolta, Inc., Tokyo (JP)

(72) Inventor: Nobuhiko Okano, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 169 days.

(21) Appl. No.: 16/503,347

(22) Filed: Jul. 3, 2019

(65) Prior Publication Data

US 2020/0031599 A1 Jan. 30, 2020

(30) Foreign Application Priority Data

Jul. 27, 2018 (JP) ..... JP2018-141071

(51) Int. Cl.

| | |
|---|---|
| ***B65H 1/26*** | (2006.01) |
| ***B65H 7/14*** | (2006.01) |
| ***B65H 3/48*** | (2006.01) |
| ***B65H 7/16*** | (2006.01) |

(52) U.S. Cl.

CPC ..... *B65H 7/16* (2013.01); *B65H 1/266* (2013.01); *B65H 3/48* (2013.01); *B65H 7/14* (2013.01); *B65H 2515/112* (2013.01); *B65H 2553/612* (2013.01)

(58) Field of Classification Search

CPC ... B65H 7/16; B65H 7/14; B65H 3/48; B65H 2515/112; B65H 2553/612; B65H 1/266

See application file for complete search history.

(56) References Cited

U.S. PATENT DOCUMENTS

| | | | | |
|---|---|---|---|---|
| 7,575,231 | B2 * | 8/2009 | Sasaki | B65H 29/246 271/153 |
| 8,272,634 | B2 * | 9/2012 | Fukatsu | B65H 1/14 271/97 |
| 2018/0327202 | A1 * | 11/2018 | Nakamura | B65H 3/48 |

FOREIGN PATENT DOCUMENTS

| | | | |
|---|---|---|---|
| JP | 2014-182153 | A | 9/2014 |
| JP | 2016-102861 | A | 6/2016 |

* cited by examiner

*Primary Examiner* — Patrick Cicchino

(74) *Attorney, Agent, or Firm* — Squire Patton Boggs (US) LLP

(57) ABSTRACT

A paper feeding apparatus includes a tray, an air blower, a floating detector, and a hardware processor. In the tray, a sheet of paper is loaded. The air blower blows air to the sheet loaded in the tray to float the sheet. The floating detector is provided above the sheet loaded in the tray and detects the floating of the sheet to a predetermined level. The hardware processor causes the air blower to blow the air and determines a basis weight of the sheet loaded in the tray from an air amount that has caused the floating detector to detect the floating of the sheet.

13 Claims, 10 Drawing Sheets

PAPER FEEDING APPARATUS AND IMAGE FORMING APPARATUS

BACKGROUND

1. Technological Field

The present disclosure relates to a paper feeding apparatus and an image forming apparatus.

2. Description of the Related Art

An image forming apparatus performs transfer control, fixation control, and paper conveyance control based on the basis weight of paper used for a job. Hence, if a user does not set the basis weight of paper or wrongly sets the basis weight thereof when the paper is set in a tray, and feeds the paper in such a state, poor image forming or a paper jam occurs due to inappropriate control.

To deal with such problems, there is proposed a technology for automatically determining the basis weight of paper to be used.

For example, there is disclosed in JP 2016-102861 A an apparatus having a transmitter that transmits ultrasound and a receiver that receives the ultrasound transmitted by the transmitter, wherein the apparatus determines the basis weight of a recording material on the basis of the result of the ultrasound passed through the recording material and received by the receiver.

As another example, there is disclosed in JP 2014-182153 A an apparatus having a weight sensor that is provided in a resist conveyor and detects the weight of a recording material, wherein the apparatus detects the basis weight of the recording material on the basis of the detection result obtained by the weight sensor, and the resist conveyor is provided on the upstream side of a transfer entrance guide plate in a recording material conveying direction, and sets a resist timing for the recording material before entering a transfer region.

There is known a paper feeding apparatus using air blowing, wherein the paper feeding apparatus blows air to sheets of paper loaded in a tray to float the sheet(s), and sends the floated sheet to an image forming unit. In order that such a paper feeding apparatus determines the basis weight of sheets of paper by making use of the technology disclosed in JP 2016-102861 A or JP 2014-182153 A, the paper feeding apparatus needs to be equipped with an ultrasound sensor or a weight sensor, which increases costs.

SUMMARY

Objects of the present disclosure include enabling a paper feeding apparatus using air blowing to determine the basis weight of sheets of paper loaded in a tray without an ultrasound sensor or a weight sensor.

In order to achieve at least one of the abovementioned objects, according to an aspect of the present invention, there is provided a paper feeding apparatus including: a tray where a sheet of paper is loaded; an air blower that blows air to the sheet loaded in the tray to float the sheet; a floating detector that is provided above the sheet loaded in the tray and detects the floating of the sheet to a predetermined level; and a hardware processor that causes the air blower to blow the air and determines a basis weight of the sheet loaded in the tray from an air amount that has caused the floating detector to detect the floating of the sheet.

According to another aspect of the present invention, there is provided an image forming apparatus including the paper feeding apparatus.

BRIEF DESCRIPTION OF THE DRAWINGS

The objects, advantages, and features provided by one or more embodiments of the present invention will become more fully understood from the detailed description given hereinbelow and the appended drawings that are given by way of illustration only, and thus are not intended as a definition of the limits of the present invention.

FIG. 8 is a flowchart showing a basis weight determination control process performed by a controller shown in FIG. 2 when power has been turned on;

DETAILED DESCRIPTION OF EMBODIMENTS

Hereinafter, an embodiment(s) of the present invention will be described with the drawings. Although a variety of limitations that are technically favorable for carrying out the present invention are put on the following embodiment, the scope of the present invention is not limited to the following embodiment or illustrated examples.

[Image Forming Apparatus]

Figure 1:
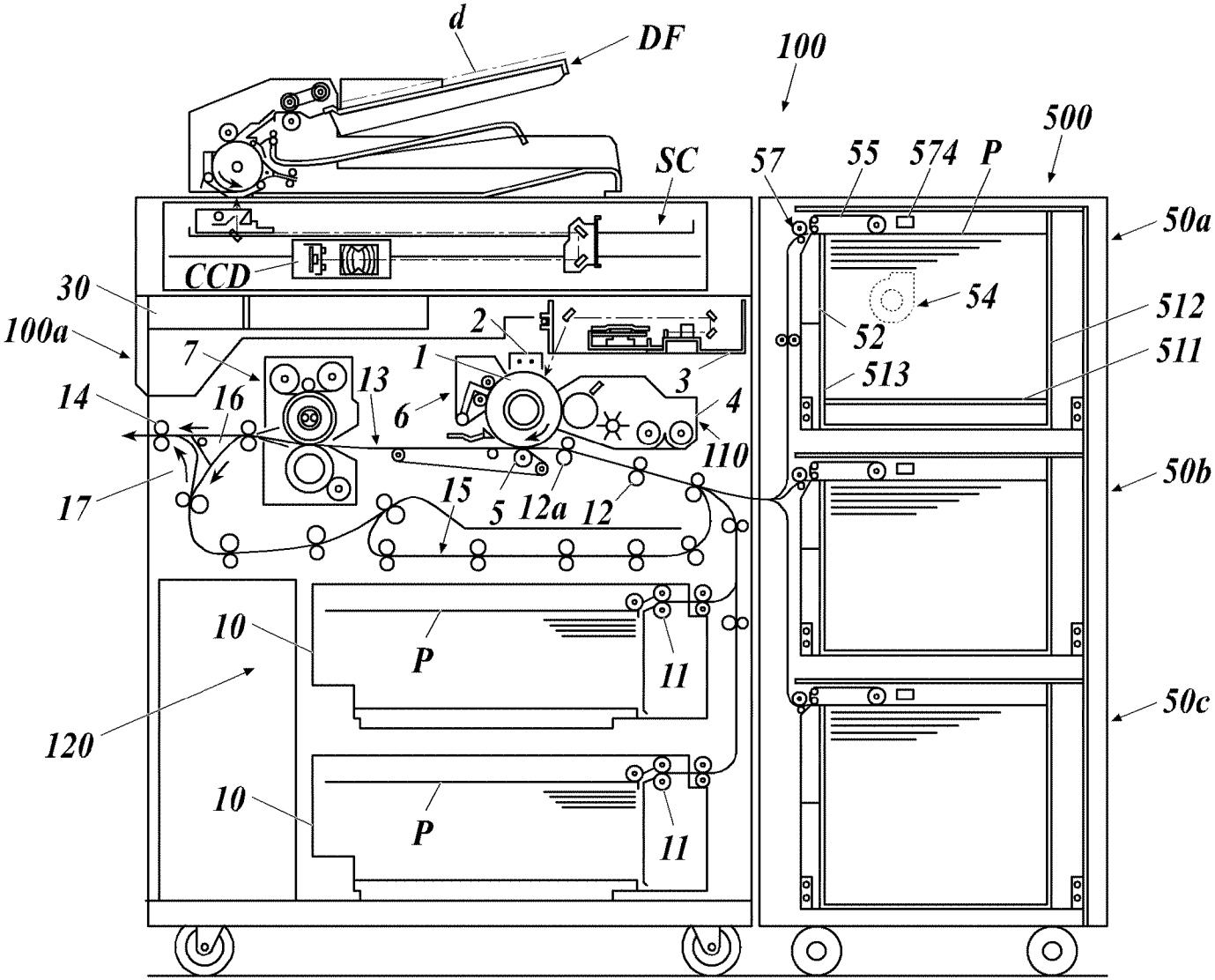
FIG. 1 schematically shows the overall configuration of an image forming apparatus according to an embodiment(s)
Figure 2:
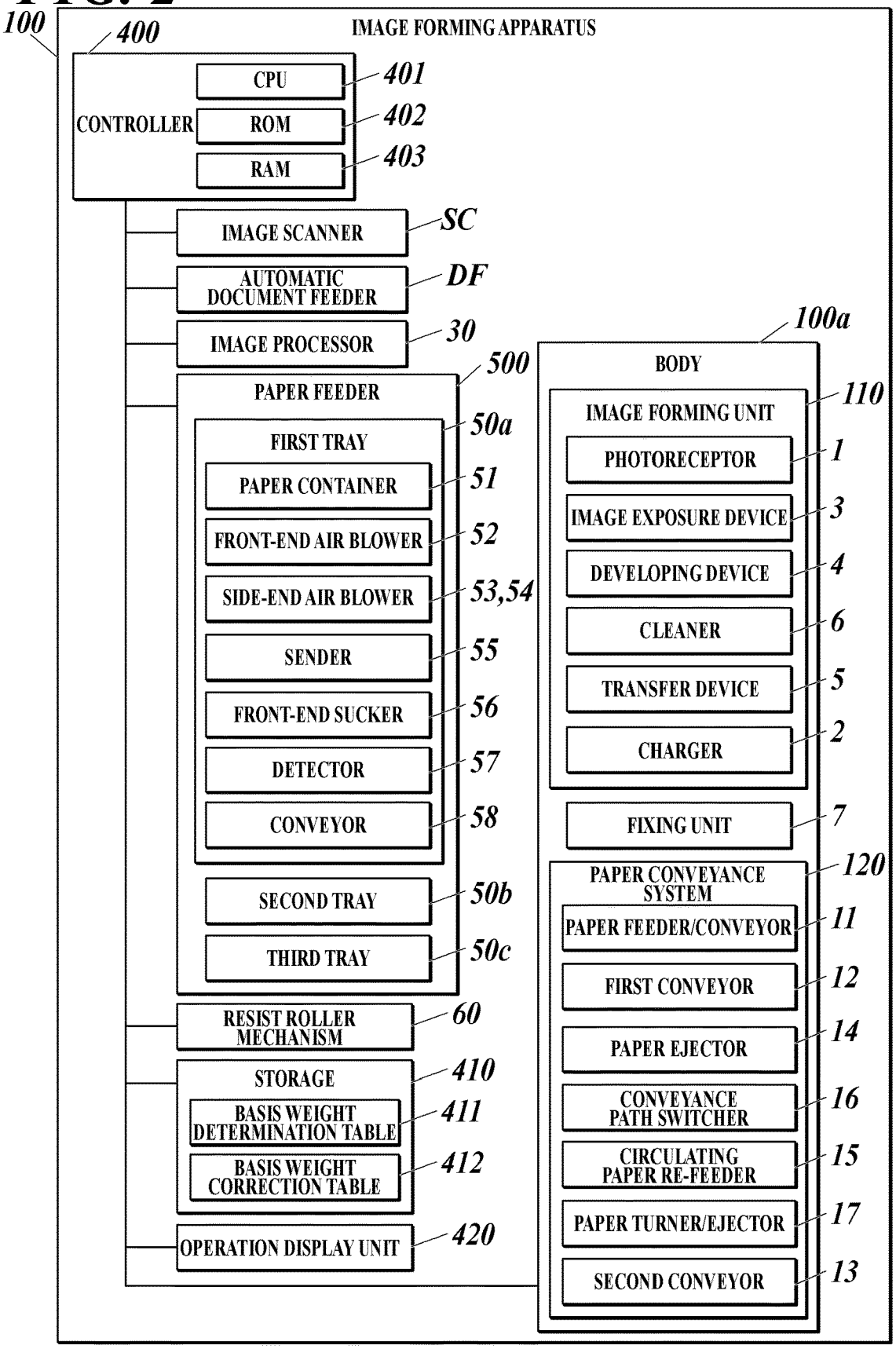
FIG. 2 is a block diagram showing a control system of the image forming apparatus.

FIG. 1 schematically shows the overall configuration of an image forming apparatus 100 according to an embodiment(s). FIG. 2 is a block diagram showing the functional configuration of the image forming apparatus 100.

As shown in FIG. 1 and FIG. 2, the image forming apparatus 100 mainly includes a body 100*a*, an image scanner SC, an automatic document feeder DF, an image processor 30, a paper feeder 500, and a controller 400. The controller 400 and the paper feeder 500 constitute a paper feeding apparatus.

The body 100*a* includes an image forming unit 110, a fixing unit 7, and a paper conveyance system 120. The image forming unit 110 includes a photoreceptor 1, a charger 2, an image exposure device 3, a developing device 4, a transfer device 5, and a cleaner 6.

The paper conveyance system 120 includes: paper feeding cassettes 10, 10 that store sheets of paper P; paper feeders/conveyors 11, 11 that feed the sheets of the paper P from the respective paper feeding cassettes 10, 10 one by one; a first conveyer 12 that conveys the sheets of the paper P fed by the paper feeders/conveyors 11, 11 or sheets of paper P fed by the paper feeder 500 to a point just before the image forming unit 110; a second conveyer 13 that conveys the sheets of the paper P conveyed by the first conveyer 12 to the downstream side of the fixing unit 7; a paper ejector 14 that conveys the sheets of the paper P to a paper receiving tray (not shown); a circulating paper re-feeder 15 that branches off from the second conveyer 13 and re-meets the first conveyer 12; a conveyance path switcher 16 that switches a conveyance path between the paper ejector 14 and the circulating paper re-feeder 15; and a paper turner/ejector 17 that branches off from the circulating paper re-feeder 15 and turns the sheets of the paper P. The "sheet(s)" or "paper" in this application includes sheet-shaped fabric and resin.

The paper feeder 500 includes a first tray 50*a*, a second tray 50*b*, and a third tray 50*c* that are vertically aligned.

[Automatic Document Feeder and Image Scanner]

The automatic document feeder DF conveys documents d placed on a platen to the image scanner SC. The image scanner SC reads images on one or both sides of the conveyed documents d with an image sensor CCD. The image sensor CCD photo-electrically converts the images, thereby obtaining analog signals. The image processor 30 performs analog processing, A/D conversion, shading correction, image compression, and/or the like on the analog signals, and sends the processed signals as image signals to the image exposure device 3.

The controller 400 is communicable, with a communication unit (not shown), with external apparatuses (e.g. personal computers) connected through a communication network, and may send image signals received from the external apparatuses to the image exposure device 3 via the image processor 30.

[Image Forming Unit]

In the image forming unit 110, the charger 2 charges the photoreceptor 1, the image exposure device 3 irradiates the photoreceptor 1 with a laser beams, thereby forming an electrostatic latent image, and the developing device 4 visualizes/develops the electrostatic latent image, thereby forming a toner image.

A sheet of the paper P stored in one of the paper feeding cassettes 10, 10 and fed/conveyed therefrom by its corresponding paper feeder/conveyor 11 is synchronized with the toner image by a resist roller 12*a* of the first conveyer 12, and is further conveyed. Thereafter, the transfer device 5 transfers the toner image to the sheet, and the fixing unit 7 fixes the toner image to the sheet.

Instead of the sheet of the paper P stored in one of the paper feeding cassettes 10, 10, a sheet of paper P stored in the paper feeder 500 may be fed to the body 100*a* where the toner image is transferred to the sheet.

The paper ejector 14 ejects the sheet with the fixed image from the image forming apparatus 100. The cleaner 6 removes the residual toner remaining on the photoreceptor 1 after the transfer. In double-sided printing, the conveyance path switcher 16 sends the sheet with the image on the first side to the circulating paper re-feeder 15 where the sheet is turned. The image forming unit 110 forms an image on the second side, and thereafter the paper ejector 14 ejects the sheet from the image forming apparatus 100. In turning ejection, the paper turner/ejector 17 sends backward and thereby turns the sheet deviated from a normal ejection path, and thereafter the paper ejector 14 ejects the sheet from the image forming apparatus 100.

[Paper Feeding Apparatus]

Figure 3:
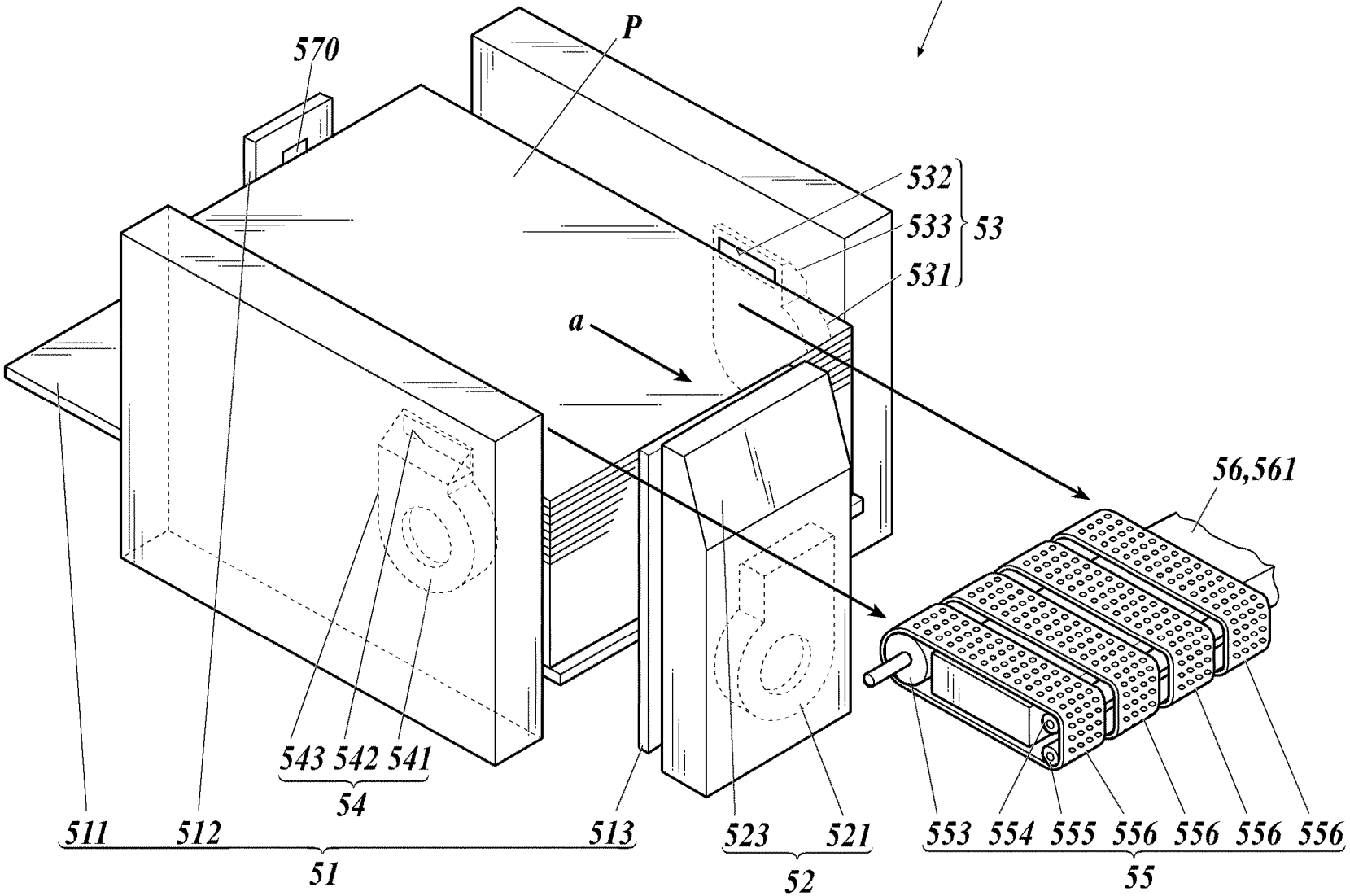
FIG. 3 is a perspective view of a paper feeding apparatus of the image forming apparatus.

FIG. 3 is a schematic perspective view of the first tray 50*a* of the paper feeder 500. The first tray 50*a*, the second tray 50*b*, and the third tray 50*c*, which are vertically aligned in the paper feeder 500 as described above, have the same configuration, for example. Hereinafter, the first tray 50*a* will be described.

The first tray 50*a* includes a paper container 51, a front-end air blower 52, side-end air blowers 53, 54, a sender 55, a front-end sucker 56, a detector 57, and a conveyer 58.

[Paper Container and Surroundings Thereof]

The paper container 51 includes: a paper loading board 511 that is provided horizontally and where sheets of paper P are loaded in a stacked manner; a rear-end regulating member 512 that is provided behind the paper loading board 511, i.e. on the upstream side of the paper loading board 511 in a paper feeding direction a; and a front-end regulating member 513 that is provided in front of the paper loading board 511, i.e. on the downstream side of the paper loading board 511 in the paper feeding direction a.

In the following description of the paper feeder 500, the left-hand direction and the right-hand direction with respect to the paper feeding direction a are referred to as "left" and "right", respectively, wherein the left-hand direction and the right-hand direction are a horizontal direction perpendicular to the paper feeding direction a.

The paper loading board 511 is supported vertically movably in the first tray 50*a*, and the front-end regulating member 513 is fixed in the first tray 50*a*.

The upper end of the front-end regulating member 513 is positioned somewhat lower than the upper end of the rear-end regulating member 512. The paper loading board 511 moves up and down by an actuator (not shown), and when the sheets of the paper P are fed, the controller 400 controls the actuator such that the top of the stacked sheets on the paper loading board 511 is always at a specific level that is slightly lower than the upper end of the front-end regulating member 513. This level control using the actuator is based on the level of the top sheet that is detected by a paper level detection sensor 570 described below.

During no paper feeding, the actuator is controlled to lower the paper loading board 511.

The rear-end regulating member 512 is movable along the paper feeding direction a by an actuator (not shown) to be suitable for the length of the paper P along the paper feeding direction a.

[Front-End Air Blower and Side-End Air Blower]

The front-end air blower 52 is provided adjacent to the front-end regulating member 513 on the downstream side of the front-end regulating member 513 in the paper feeding direction a. The side-end air blowers 53, 54 are provided on the left and right of the paper loading board 511, respectively. The side-end air blowers 53, 54 include flat and vertical inner side walls that function as regulating members for regulating the position of the paper P in the right-left direction.

The front-end air blower 52 and the side-end air blowers 53, 54 respectively have air blowing fans 521, 531, 541 inside to blow air through their respective air outlets 522 (shown in FIG. 4), 532, 542.

Figure 4:
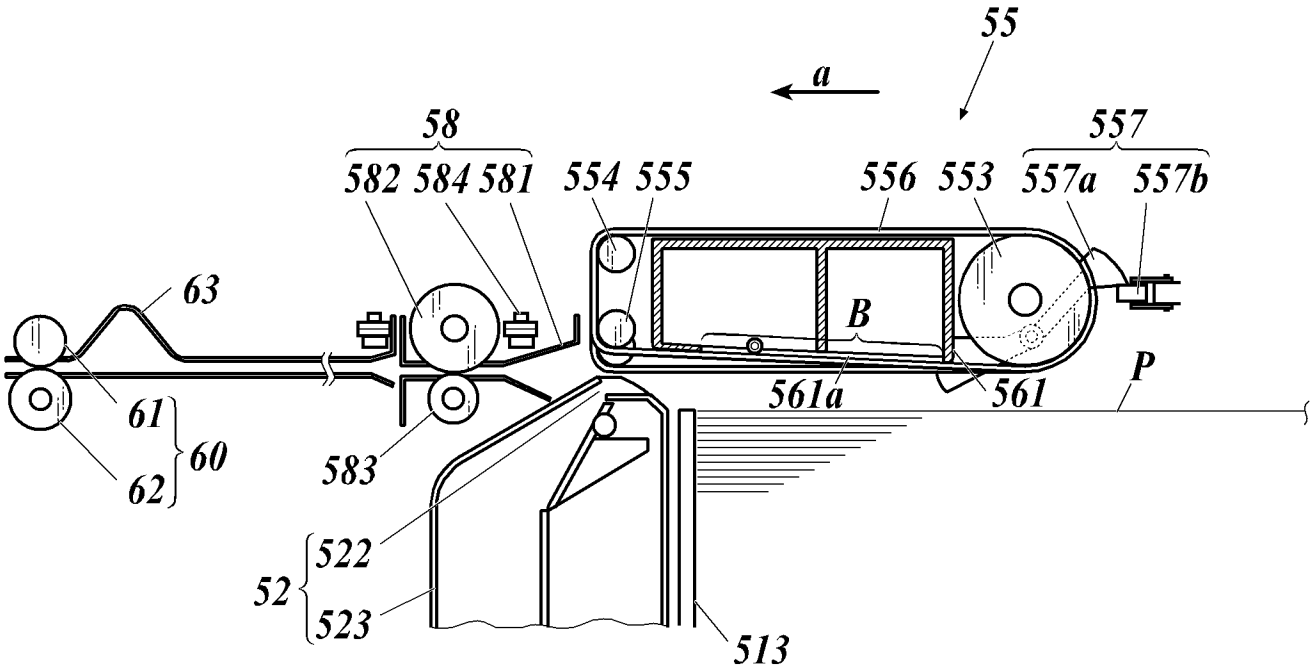
FIG. 4 is a cross-sectional view of the paper feeding apparatus some components of which are omitted.

FIG. 4 is a cross-sectional view showing components around the front-end in the paper feeding direction a of the top sheet of the paper P loaded on the paper loading board 511.

The front-end air blower 52 includes a nozzle 523 for blowing air through the air outlet 522 in a direction somewhat inclined upward from the direction opposite to the paper feeding direction a. The front-end air blower 52 includes a switching valve (not shown) in the nozzle 523 to switch an air blowing direction between two, i.e. upward blowing and downward blowing. In the downward blowing, air is blown to an end face of the loaded paper P, which is highly effective in floating the paper P. In the upward blowing, air is blown to the front-end of the floated paper P, which is highly effective in separating the top sheet of the paper P from sheets below floated together with the top sheet.

As shown in FIG. 3, the side-end air blowers 53, 54 include nozzles 533, 543 for blowing air to the top sheet positioned at the specific level from the left and right of the top sheet in the horizontal direction or a direction somewhat inclined upward from the horizontal direction. The air outlets 532, 542 of the nozzles 533, 543 are formed such that their upper edges are positioned higher than the top sheet positioned at the specific level while their lower edges are positioned lower than the top sheet.

Thus, the side-end air blowers 53, 54, which blow air through the air outlets 532, 542, blow air to one or more sheets from the top of the stacked sheets of the paper P loaded on the paper loading board 511 of the first tray 50*a* to raise/float the one or more sheets.

The downward blowing by the front-end air blower 52 and the blowing by the side-end air blowers 53, 54 provide floating air for floating the loaded sheets. Either the downward blowing by the front-end air blower 52 or the blowing by the side-end air blowers 53, 54 may provide the floating air.

The upward blowing by the front-end air blower 52 provides separating air for separating the floated sheets into the top sheet and sheets below floated together with the top sheet.

[Sender and Sucker]

Figure 5:
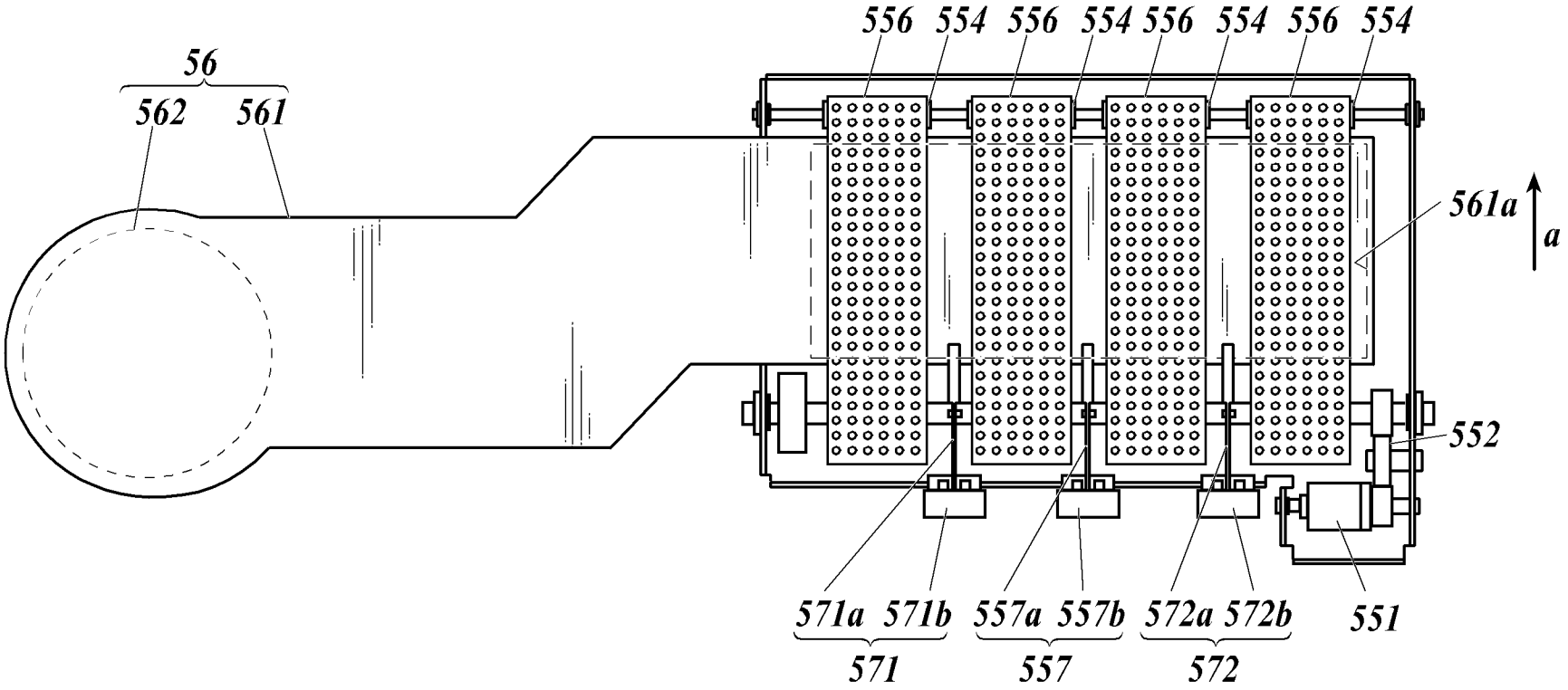
FIG. 5 is a plan view of a sender and a front-end sucker of the paper feeding apparatus.

FIG. 5 is a plan view of the sender 55 and the front-end sucker 56. As shown in FIG. 3 to FIG. 5, the sender 55 is provided above the paper loading board 511. In FIG. 3, the sender 55 is deviated and shown at a location indicated by arrows so that the surrounding components are not hidden. In practice, however, the sender 55 is provided above the downstream end in the paper feeding direction a of the paper loading board 511 as shown in FIG. 4.

The sender 55 includes four belt mechanisms aligned in the horizontal direction perpendicular to the paper feeding direction a, a motor 551 as a paper feeding driver that drives the belt mechanisms, and a transmission gear train 552 that intervenes between the belt mechanisms and the motor 551.

Each of the belt mechanisms includes a large-diameter roller 553 provided on the upstream side in the paper feeding direction a, two small-diameter rollers 554, 555 provided on the downstream side in the paper feeding direction a, and a belt 556 put across the rollers 553, 554, 555. The motor 551 applies torque to the large-diameter rollers 553 of the belt mechanisms to move the lower side of the belts 556 in the paper feeding direction a. Instead of the rollers 553, 554, 555, sprockets may be used.

The belts 556 have small through holes over the entire surface, and the paper P can be attached to the lower side of the belts 556 by suction of the front-end sucker 56, described below, through the small holes.

On the upstream side in the paper feeding direction a of the belt mechanisms, an attachment detector 557 is provided to detect attachment of the paper P to the belts 556. The attachment detector 557 includes a body 557*a* and an optical sensor 557*b*. The body 557*a* is approximately bar-shaped and supported swingably.

One end of the body 557*a* protrudes downward from the lower side of the belts 556. When the paper P is attached to the belts 556, the body 557*a* swings, so that the one end is pushed back upward. The body 557*a* is arranged such that when the one end is pushed back upward, the other end moves downward in such a way as to cover the optical sensor 557*b*. The optical sensor 557*b* inputs, to the controller 400, change in the amount of received light due to being covered so that the controller 400 recognizes the attachment of the paper P.

As shown in FIG. 3 to FIG. 5, the front-end sucker 56 includes: a first duct 561 with one end inserted in the belts 556 of the sender 55; and a first fan 562 that is provided at the other end of the first duct 561 to create a negative pressure in the first duct 561.

The one end of the first duct 561, which is inserted in the belts 556, is formed to be approximately cuboid with a first opening 561*a* formed in its lower side. The front-end sucker 56 can draw outside air through the first opening 561*a* by creating a negative pressure in the first duct 561 with the first fan 562.

The first opening 561*a* of the first duct 561 is arranged over the lower side of the four belts 556, and a portion of the belts 556 corresponding to the first opening 561*a* is a first attachment region B where the paper P is attached.

Operation of the sender 55 and the front-end sucker 56 in paper feeding will be described.

When the front-end air blower 52 and the side-end air blowers 53, 54 blow the floating air, thereby floating one or more sheets from the top of the sheets of the paper P loaded on the paper loading board 511, the sender 55 and the front-end sucker 56 draw the front-end portion of the top sheet of the floated sheets by suction force created in the first attachment region B so that the front-end portion thereof is attached to the lower side of the belts 556. Rotary drive of the belts 556 of the sender 55 in this state enables sending of the floated top sheet in the paper feeding direction a.

[Conveyer]

As shown in FIG. 4, the conveyer 58 is provided in proximity to the sender 55 on the downstream side of the sender 55 in the paper feeding direction a. The conveyer 58 includes: an insertion guide 581 to which the sheet sent from the lower side of the belts 556 is insertable; a large conveyance roller 582 and a small conveyance roller 583 that are provided in the middle of the insertion guide 581 to nip and convey the sheet to the downstream side in the paper feeding direction a; a motor (not shown) as a driver that rotationally drives the conveyance rollers 582, 583; and a paper detector 584 constituted of an optical or contact sensor that detects arrival of the front-end of the sheet at the insertion guide 581 and passage of the rear-end of the sheet through the insertion guide 581.

The end of the insertion guide 581 on the upstream side in the paper feeding direction a is widely open in the vertical direction, and formed in such a way as to have the vertical width that gradually decreases in the paper feeding direction a. The end thereof on the upstream side in the paper feeding direction a leads to a conveyance path for the paper P to travel to the body 100*a*.

The large-diameter conveyance roller 582 and the small-diameter conveyance roller 583 are arranged in the insertion guide 581 in such a way as to be in contact with each other so that the sheet having entered the insertion guide 581 passes through between the large-diameter conveyance roller 582 and the small-diameter conveyance roller 583.

The large-diameter conveyance roller 582 is driven by a motor (not shown) that is controlled by the controller 400. The small-diameter conveyance roller 583, which is in contact with the large-diameter conveyance roller 582, receives opposite torque to the large-diameter conveyance roller 583, and rotates as the large-diameter conveyance roller 582 rotates.

The paper detector 584 is provided in proximity to the conveyance rollers 582, 583 on the upstream side of the conveyance rollers 582, 583 in the paper feeding direction a. The paper detector 584 detects whether or not the sheet is present there, and constantly inputs the detection result to the controller 400. That is, when the detection state changes from a sheet absent state to a sheet present state, the controller 400 recognizes arrival of the front-end of the sheet at the paper detector 584, whereas when the detection state changes from the sheet present state to the sheet absent state, the controller 400 recognizes passage of the rear-end of the sheet through the paper detector 584.

As used herein, the front-end of the sheet (or the paper P) refers to the end of the sheet (or the paper P) on the downstream side in the paper feeding direction a, and the rear-end of the sheet (or the paper P) refers to the end of the sheet (or the paper P) on the upstream side in the paper feeding direction a.

[Detector]

The detector 57 includes the paper level detection sensor 570 (paper level detector), an upper limit detection sensor 571 (upper limit detector), a floating detection sensor 572 (floating detector), a curl detection sensor 573 (curl detector), and an opening/closing detection sensor 574 (opening/closing detector).

The paper level detection sensor 570 detects the level of the paper P loaded. For example, the paper level detection sensor 570 (shown in FIG. 3) is constituted of an optical sensor and/or the like provided on the rear-end regulating member 512 in such a way as to face the paper P, and measures the level of the top sheet of the paper P and inputs the same to the controller 400. The controller 400 recognizes the level of (the top sheet of) the paper P on the basis of the input from the paper level detection sensor 570.

The upper limit detection sensor 571 detects whether or not the level of the top sheet of the paper P stored in the paper container 51 has reached the upper limit (specific level). The upper limit detection sensor 571 (shown in FIG. 5) includes, as with the attachment detector 557 as an example, a body 571*a* that is supported swingably and an optical sensor 571*b*. One end of the body 571*a* of the upper limit detection sensor 571 protrudes downward from the lower side of the belts 556 to the specific level for the paper P. When the paper P reaches the specific level and accordingly contacts the body 571*a*, the body 571*a* swings, so that the one end is pushed back upward. The body 571*a* is arranged such that when the one end is pushed back upward, the other end moves downward in such a way as to cover the optical sensor 571*b*. The optical sensor 571*b* inputs, to the controller 400, change in the amount of received light due to being covered. The controller 400 recognizes that the paper P has reached the upper limit (the upper limit detection sensor 571 is on) when the optical sensor 571*b* indicates the amount of received light at the time of being covered.

The floating detection sensor 572 detects whether or not the level of the top sheet of the paper P stored in the paper container 51 has floated to a predetermined level (floating level). The floating detection sensor 572 (shown in FIG. 5) includes, as with the attachment detector 557 as an example, a body 572*a* that is supported swingably and an optical sensor 572*b*. One end of the body 572*a* of the floating detection sensor 572 protrudes downward from the lower side of the belts 556 to the predetermined level. When the paper P reaches the predetermined level and accordingly contacts the body 572*a*, the body 572*a* swings, so that the one end is pushed back upward. The body 572*a* is arranged such that when the one end is pushed back upward, the other end moves downward in such a way as to cover the optical sensor 572*b*. The optical sensor 572*b* inputs, to the controller 400, change in the amount of received light due to being covered. The controller 400 recognizes that the paper P has floated to the predetermined level (the floating detection sensor 572 is on) when the optical sensor 572*b* indicates the amount of received light at the time of being covered.

Figure 6:
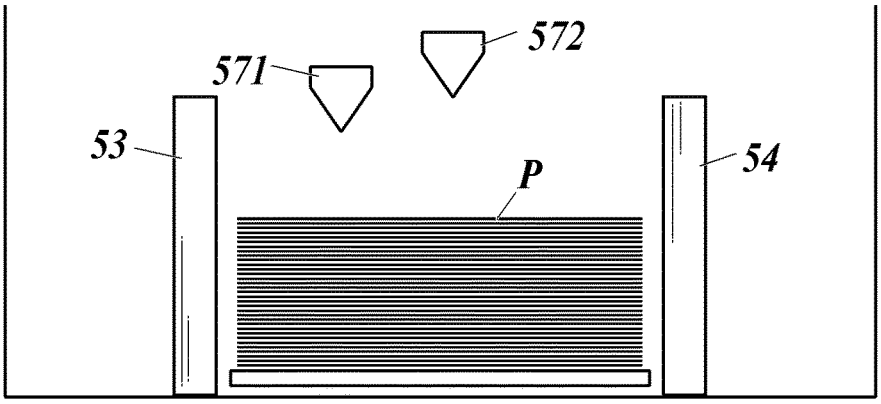
FIG. 6 schematically shows a positional relationship between an upper limit detection sensor and a floating detection sensor.

FIG. 6 schematically shows a positional relationship between the upper limit detection sensor 571 and the floating detection sensor 572 viewed from the upstream side in the paper feeding direction a. As shown in FIG. 6, the floating detection sensor 572 is positioned higher than the upper limit detection sensor 571.

The configurations of the upper limit detection sensor 571 and the floating detection sensor 572 are not limited to those described above. For example, the upper limit detection sensor 571 may be constituted of: a light source that emits light to the top sheet of the paper P; and an optical sensor including a light receiving element that receives reflected light from the top sheet of the paper P, and measure and input the distance to the top sheet of the paper P to the controller 400. In this case, the controller 400 recognizes that the top sheet of the paper P stored in the paper container 51 has reached the specific level (the upper limit detection sensor 571 is on) when the distance between the upper limit detection sensor 571 and the top sheet is a predetermined distance D1 or shorter. Similarly, the floating detection sensor 572 may be constituted of a light source and an optical sensor, and measure and input the distance to the top sheet of the paper P to the controller 400. In this case, the controller 400 recognizes that the top sheet of the paper P stored in the paper container 51 has floated to the predetermined level (the floating detection sensor 572 is on) when the distance between the floating detection sensor 572 and the top sheet is a predetermined distance D2 or shorter.

Figure 7A:
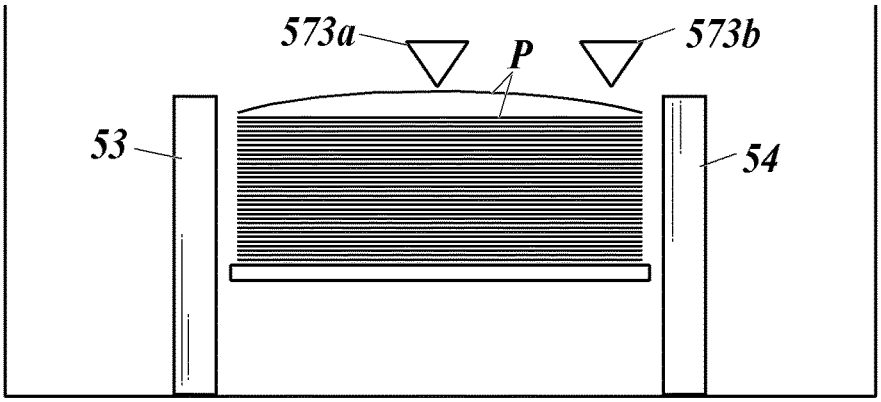
FIG. 7A schematically shows convex curl.
Figure 7B:
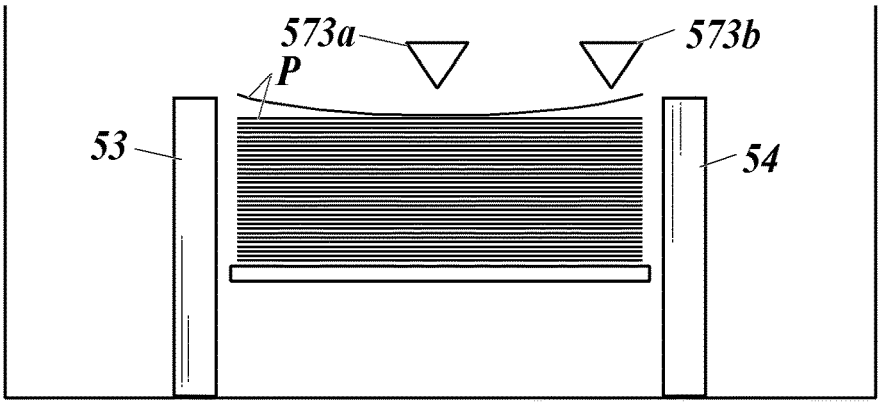
FIG. 7B schematically shows concave curl.

The curl detection sensor 573 detects a curl direction and a curl amount of (the top sheet of) the paper P stored in the paper container 51. As shown in FIG. 7A and FIG. 7B, the curl detection sensor 573 includes a central sensor 573*a* and an end sensor 573*b*. The central sensor 573*a* is, for example, an optical sensor provided above the paper container 51 in such a way as to face the center of the paper P, and measures the distance to the center of the paper P. The end sensor 573*b* is, for example, an optical sensor provided above the paper container 51 in such a way as to face an end (the end close to the air outlet 532 or the end close to the air outlet 542) of the paper P, and measures the distance (level) to the end of the paper P. The curl detection sensor 573 inputs the difference (difference in level) between the measured value by the central sensor 573*a* and the measured value by the end sensor 573*b* as the detection result about the curl direction and the curl amount to the controller 400. The controller 400 recognizes the curl direction (whether the curl is convex (i.e. convex upward) or concave (i.e. convex downward)) and the curl amount from the detection result obtained by the curl detection sensor 573.

The opening/closing detection sensor 574 detects and inputs opening and closing of the first tray 50*a* to the controller 400.

[Controller, Storage, and Operation Display Unit]

The controller 400 includes a CPU (Central Processing Unit) 401, a ROM (Read Only Memory) 402, and a RAM (Random Access Memory) 403. The CPU 401 reads a program(s) for a desired process from the ROM 402, loads the read program into the RAM 403, and integrally controls operation of each of the components (image scanner SC, automatic document feeder DF, image processor 30, body 100*a*, paper feeder 500, etc.) of the image forming apparatus 100 in cooperation with the loaded program. At the time, the CPU 401 refers to a variety of data stored in a storage 410.

The controller 400 also includes a communication unit constituted of a communication control card (not shown), such as a LAN card, and sends/receives, with the communication unit, a variety of data to/from external apparatuses (e.g. personal computers) connected through a communication network, such as a LAN (Local Area Network) or a WAN (Wide Area Network).

The storage 410 is constituted of, for example, a non-volatile semiconductor memory (so-called flash memory) or a hard disk drive.

The storage 410 stores various types of setting information, such as paper setting information (tray setting) on a paper type, a paper size, a basis weight, and so forth about each of the paper feeding cassettes 10, 10 and the first tray 50*a* to the third tray 50*c*.

The storage 410 also stores a basis weight determination table 411 (shown in FIG. 10) and a basis weight correction table 412 (shown in FIG. 11) that are used in a basis weight determination process described below. The basis weight determination table 411 and the basis weight correction table 412 are described below.

The storage 410 also stores loaded paper amounts in the trays (first tray 50*a* to third tray 50*c*) during power-off and loaded paper amounts in the trays after tray opening and closing, job setting information (paper type, basis weight, paper size, paper feeding tray (cassette), density, magnification, double-sided printing or single-sided printing, etc.), image data, and so forth.

An operation display unit 420 includes: a touchscreen to receive input operations in accordance with information displayed on a display; and various operation keys/buttons including a numeric keypad, a start button, and a power button to switch between power-on and power-off, for example. The operation display unit 420 receives various input operations made by a user(s) and inputs the operation signals to the controller 400. The user can input various types of setting information (tray setting, job setting, etc.), action instructions, and so forth with the operation display unit 420.

[Determination of Basis Weight by Paper Feeding Apparatus]

The controller 400 performs transfer control, fixation control, and paper conveyance control based on the basis weight of the paper P used for a job. Hence, if the basis weight of the paper P is not set or wrongly set when the paper P is set in a tray, and the paper P is fed in such a state, poor image forming or a paper jam occurs due to inappropriate control.

To deal with such problems, in this embodiment, when power has been turned on, when a tray (any of the first tray 50*a* to the third tray 50*c*) has been opened and closed, when the tray setting about a tray has been changed, when paper feeding is about to start, and/or when an instruction to determine the basis weight has been made by an user operation, automatic determination of the basis weight is performed.

The following process is performed on the assumption that when the power is turned off and also after a tray is opened and closed, the controller 400 calculates and stores in the storage 410 a loaded paper amount in each tray (after a tray is opened and closed, in this opened-and-closed tray) of the paper feeder 500 from a detection result obtained by the paper level detection sensor 570 of the tray.

[When Power has been Turned On]

Figure 8:
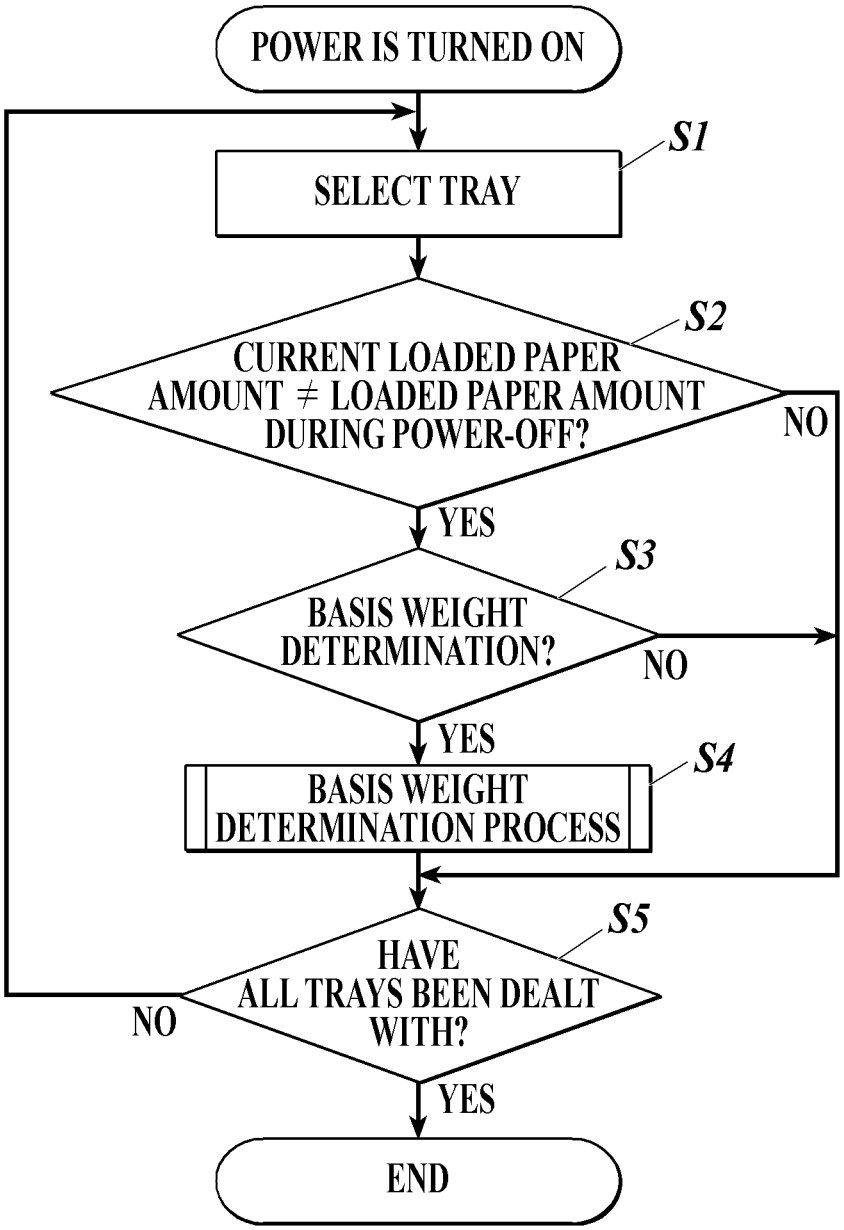

FIG. 8 is a flowchart showing a basis weight determination control process performed by the controller 400 when the power has been turned on. The process shown in FIG. 8 is performed by the CPU 401 and the program(s) stored in the ROM 402 of the controller 400 working together.

First, the controller 400 selects one of the three trays of the paper feeder 500 (Step S1), and, about the selected tray, calculates the current loaded paper amount on the basis of the detection result obtained by the paper level detection sensor 570, and determines whether or not the current loaded paper amount is different from the loaded paper amount the last time the power has been turned off (previous loaded paper amount), the previous loaded paper amount being stored in the storage 410 (Step S2).

If the controller 400 determines that the current loaded paper amount is not different from (is the same as) the loaded paper amount the last time the power has been turned off (Step S2; NO), the controller 400 proceeds to Step S5.

If the controller 400 determines that the current loaded paper amount is different from the loaded paper amount the last time the power has been turned off (Step S2; YES), the controller 400 causes the operation display unit 420 to display a choice screen for the user to choose whether or not to perform the basis weight determination, and determines whether or not the user has chosen to perform the basis weight determination (Step S3).

If the controller 400 determines that the user has chosen not to perform the basis weight determination (Step S3; NO), the controller 400 proceeds to Step S5.

If the controller 400 determines that the user has chosen to perform the basis weight determination (Step S3; YES), the controller 400 performs a basis weight determination process (Step S4), and proceeds to Step S5.

Figure 9:
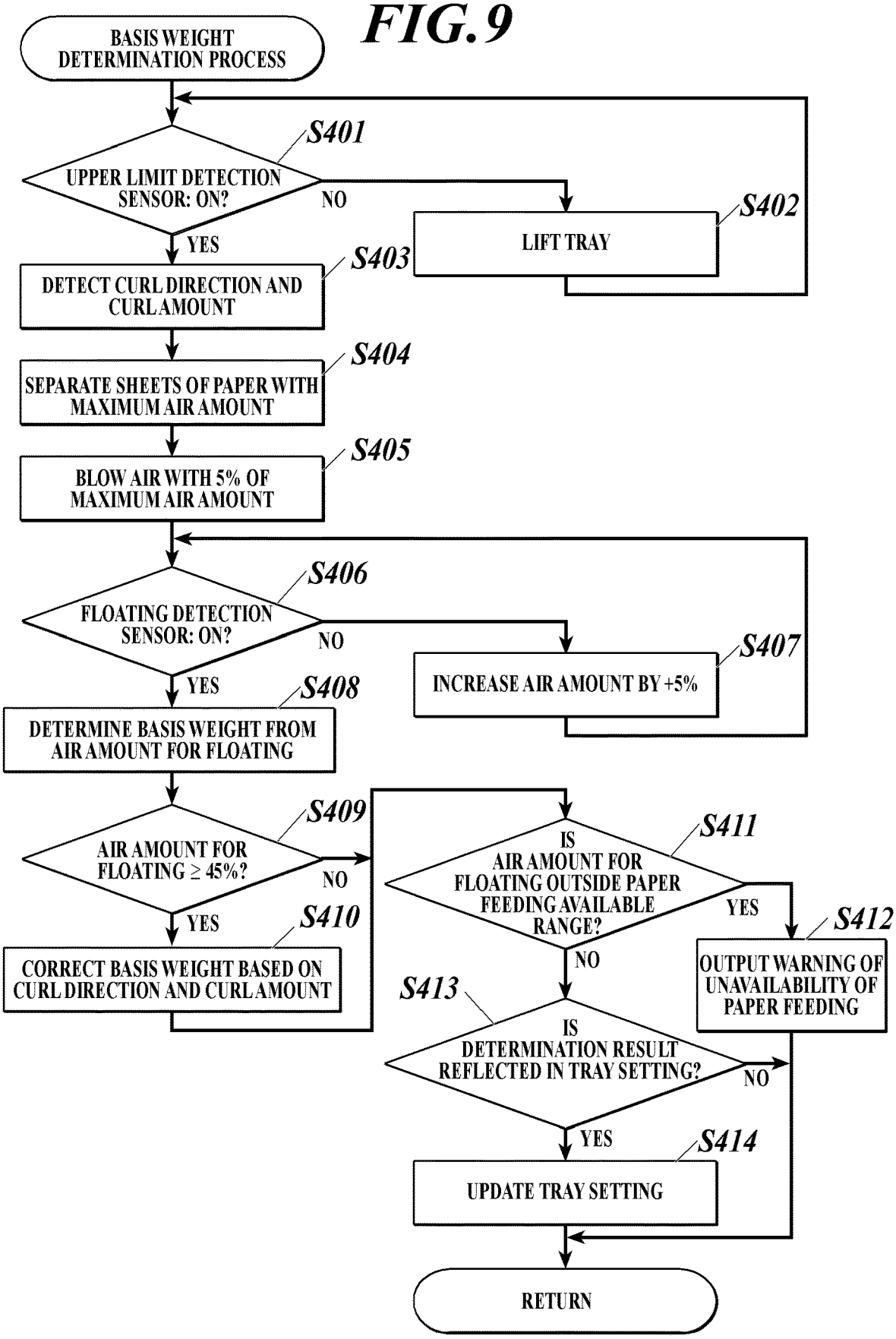
FIG. 9 is a flowchart showing a basis weight determination process performed in Step S4 shown in FIG. 8.

FIG. 9 is a flowchart showing the basis weight determination process performed in Step S4. The basis weight determination process is performed by the CPU 401 and the program(s) stored in the ROM 402 of the controller 400 working together.

First, the controller 400 determines whether or not the upper limit detection sensor 571 is on (Step S401). If the controller 400 determines that the upper limit detection sensor 571 is not on (is off) (Step S401; NO), the controller 400 causes the paper loading board 511 to move up (Step S402), and returns to Step S401.

If the controller 400 determines that the upper limit detection sensor 571 is on (Step S401; YES), the controller 400 obtains and stores in the RAM 403 the curl direction and the curl amount detected by the curl detection sensor 573 (Step S403).

Next, the controller 400 causes the side-end air blowers 53, 54 to blow air with the maximum air amount to separate sheets of the paper P (Step S404).

The sheets of the paper P loaded in the tray may stick to one another due to, for example, moisture or burrs generated at the time of cutting of the paper P. If air is blown in such a state to float a sheet(s) of the paper P, the basis weight thereof may not be determined correctly. Hence, before blowing air for determining the basis weight, the side-end air blowers 53, 54 blow air with the maximum air amount to separate the sheets of the paper P in order to unstick the sheets from one another and float the sheets. After a period of time required for the floated paper P to fall elapses, the controller 400 proceeds to Step S405. The air amount in Step S404 is not necessarily the maximum air amount as far as it is larger than a predetermined threshold that can separate the sheets of the paper P.

In Step S405, the controller 400 causes the side-end air blowers 53, 54 to blow air with 5% of the maximum air amount (Step S405), and determines whether or not the floating detection sensor 572 has been turned on (Step S406).

If the controller 400 determines that the floating detection sensor 572 has not been turned on yet (Step S406; NO), the controller 400 causes the side-end air blowers 53, 54 to increase the air amount by 5% and blow air with the increased air amount (Step S407), and returns to Step S406.

If the controller 400 determines that the floating detection sensor 572 has been turned on (Step S406; YES), the controller 400 refers to the basis weight determination table 411, and determines the basis weight of the paper P loaded in the tray from the air amount (referred to as "air amount for floating") that has turned on the floating detection sensor 572 (i.e. that has caused the floating detection sensor 572 to detect floating (of one or more sheets) of the paper P) (Step S408).

Figure 10:
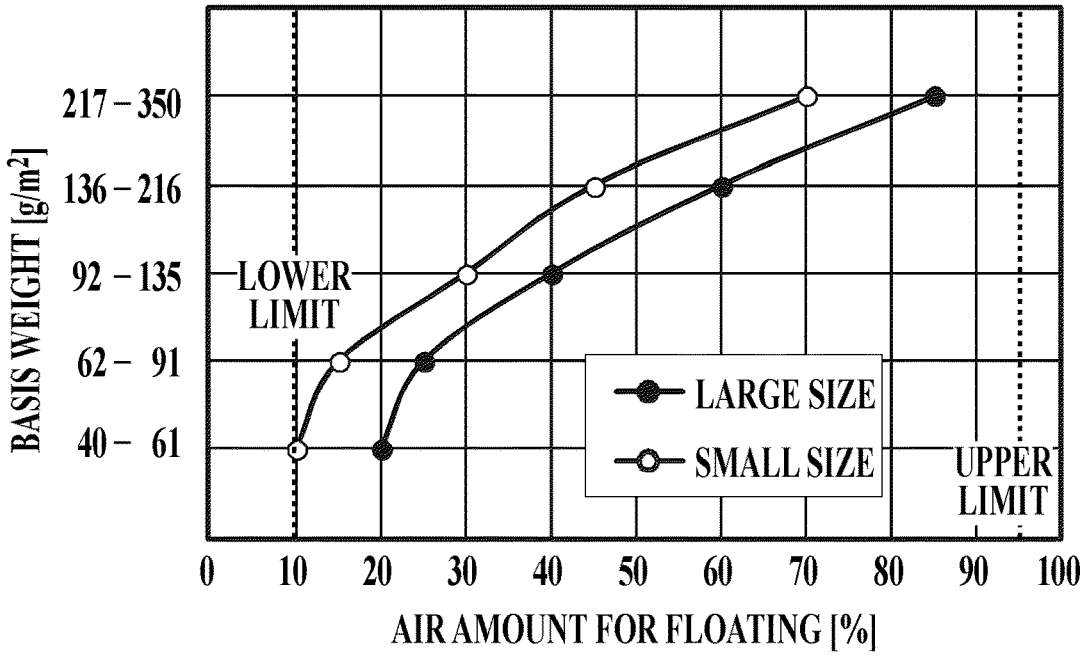
FIG. 10 shows an example of a basis weight determination table.

FIG. 10 shows an example of the basis weight determination table 411. As shown in FIG. 10, the basis weight determination table 411 is a table storing, for each paper size, information indicating a correspondence relationship between the air amount(s) of the side-end air blowers 53, 54 and the basis weight(s) of paper (i.e. a correspondence relationship between the air amount for floating and the basis weight), the air amount(s) turning on the floating detection sensor 572. The relationship between the air amount for floating and the basis weight stored in the basis weight determination table 411 has been obtained by experiment. Sheets (paper P and other paper P) having the same basis weight could have different weights depending on their sizes (sheets of paper having a large size (e.g. A3 size) are heavier than sheets of paper having a small size (e.g. A4 size). Hence, as shown in FIG. 10, even if the same air amount causes the floating detection sensor 572 to detect floating of sheets, their basis weights to be determined are different if their sizes are different. The basis weight corresponding to the air amount smaller than the lower limit or larger than the upper limit (i.e. outside a paper feeding available range) is the basis weight that makes paper feeding to the body 100*a* unavailable.

For example, in the case where the paper size of the paper P is a large size (A3), as shown in FIG. 10, the controller 400 determines that the basis weight of the paper P is 40 to 61 g/m$^2$ if the floating detection sensor 572 has been turned on with 20% of the maximum air amount of the side-end air blowers 53, 54; determines that the basis weight of the paper P is 62 to 91 g/m$^2$ if the floating detection sensor 572 has been turned on with 25% of the maximum air amount thereof; . . . ; and determines that the basis weight of the paper P is 217 to 350 g/m$^2$ if the floating detection sensor 572 has been turned on with 85% of the maximum air amount thereof.

As another example, in the case where the paper size of the paper P is a small size (A4), as shown in FIG. 10, the controller 400 determines that the basis weight of the paper P is 40 to 61 g/m$^2$ if the floating detection sensor 572 has been turned on with 10% of the maximum air amount of the side-end air blowers 53, 54; determines that the basis weight of the paper P is 62 to 91 g/m$^2$ if the floating detection sensor 572 has been turned on with 15% of the maximum air amount thereof; . . . ; and determines that the basis weight of the paper P is 217 to 350 g/m$^2$ if the floating detection sensor 572 has been turned on with 70% of the maximum air amount thereof.

Next, the controller 400 determines whether or not "Air Amount for Floating ≥45%" holds (Step S409).

If the controller 400 determines that "Air Amount for Floating ≥45%" does not hold (Step S409; NO), the controller 400 proceeds to Step S411.

If the controller 400 determines that "Air Amount for Floating ≥45%" holds (Step S409; YES), the controller 400 refers to the curl direction and the curl amount obtained in Step S403, and corrects the basis weight determined in Step S408 (Step S410).

Figure 11:
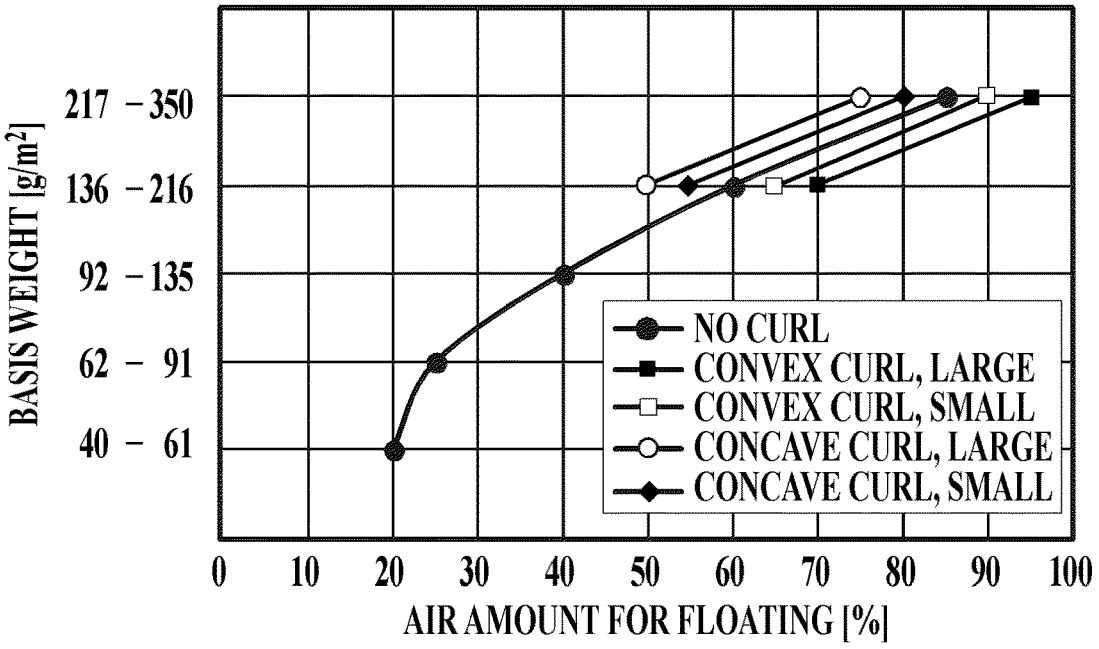
FIG. 11 shows an example of a basis weight correction table.

If the paper P set on the paper loading board 511 curls convexly (convexly upward) (shown in FIG. 7A), the paper P does not easily float, whereas if the paper P set thereon curls concavely (convexly downward) (shown in FIG. 7B), the paper P easily floats. The thicker the paper P is, the more the curl affects floating of the paper P. Hence, if the air amount for floating is a predetermined value (e.g. 45%) or larger, the controller 400 refers to the basis weight correction table 412 (shown in FIG. 11), and corrects the determined basis weight on the basis of the detection result obtained by the curl detection sensor 573. The relationship between the air amount for floating and the basis weight about each combination of the curl direction and the curl amount stored in the basis weight correction table 412 has been obtained by experiment. The correction table shown in FIG. 11 is for large-sized paper, but the basis weight correction table 412 includes a correction table for small-sized paper too. The " Curl, Large" indicates the curl amount being a predetermined threshold or larger, whereas the " Curl, Small" indicates the curl amount being smaller than the predetermined threshold.

Next, the controller 400 determines whether or not the air amount for floating is outside the paper feeding available range (Step S411).

If the controller 400 determines that the air amount for floating is outside the paper feeding available range (Step S411; YES), the controller 400 causes the operation display unit 420 to display a warning of unavailability of paper feeding (Step S412), and ends the basis weight determination process. The warning may be, for example, sounded instead of or in addition to being displayed.

If the controller 400 determines that the air amount for floating is not outside the paper feeding available range (Step S411; NO), the controller 400 causes the operation display unit 420 to display a choice screen for the user to choose whether or not to reflect the basis weight determination result in the tray setting (Step S413).

On the choice screen displayed in Step S413, the basis weight determination result and the basis weight included in the tray setting are displayed so that the user can choose whether or not to reflect the basis weight determination result in the tray setting.

If the controller 400 determines that the user has chosen to reflect the basis weight determination result in the tray setting (Step S413; YES), the controller 400 updates the tray setting stored in the storage 410 with the determined basis weight (Step S414), and ends the basis weight determination process.

If the controller 400 determines that the user has chosen not to reflect the basis weight determination result in the tray setting (Step S413; NO), the controller 400 ends the basis weight determination process.

After ending the basis weight determination process, the controller 400 determines whether or not Steps S1 to S4 have been performed for all of the trays (Step S5).

If the controller 400 determines that Steps S1 to S4 have not been performed for all of the trays yet (Step S5; NO), the controller 400 returns to Step S1.

If the controller 400 determines that Steps S1 to S4 have been performed for all of the trays (Step S5; YES), the controller 400 ends the basis weight determination control process.

[When Tray has been Opened and Closed]

Figure 12:
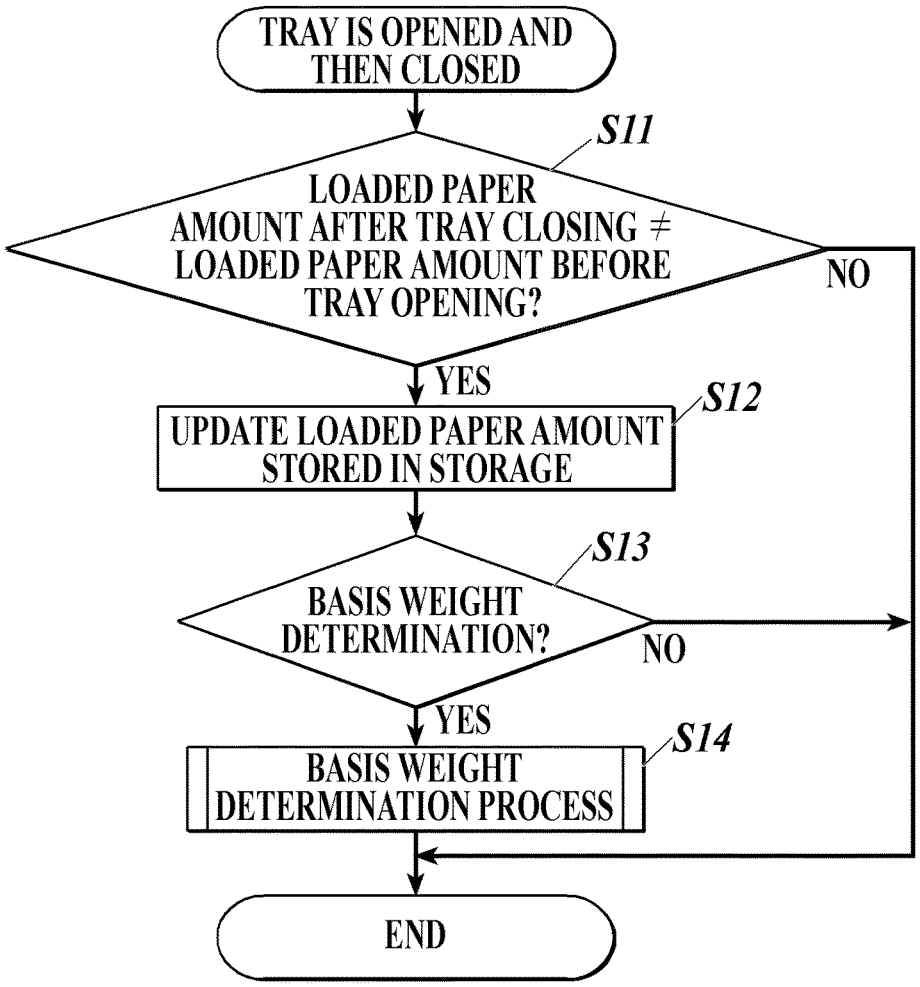
FIG. 12 is a flowchart showing a basis weight determination control process performed by the controller shown in FIG. 2 when a tray has been opened and closed.

FIG. 12 is a flowchart showing a basis weight determination control process performed by the controller 400 when the tray opening/closing detection sensor 574 of any of the trays of the paper feeder 500 detects that the tray has been opened and then closed. The process shown in FIG. 12 is performed by the CPU 401 and the program(s) stored in the ROM 402 of the controller 400 working together.

First, the controller 400 calculates the loaded paper amount after the tray has been closed (after opening/closing loaded paper amount) on the basis of the detection result obtained by the paper level detection sensor 570 of the opened and closed tray, and determines whether or not the loaded paper amount after the tray has been closed is different from the loaded paper amount before the tray has been opened (the loaded paper amount stored in the storage 410; before opening/closing loaded paper amount) (Step S11).

If the controller 400 determines that the loaded paper amount after the tray has been closed is not different from (is the same as) the loaded paper amount before the tray has been opened (Step S11; NO), the controller 400 ends the basis weight determination control process.

If the controller 400 determines that the loaded paper amount after the tray has been closed is different from the loaded paper amount before the tray has been opened (Step S11; YES), the controller 400 updates the loaded paper amount stored in the storage 410 (Step S12).

Next, the controller 400 causes the operation display unit 420 to display a choice screen for the user to choose whether or not to perform the basis weight determination, and determines whether or not the user has chosen to perform the basis weight determination (Step S13).

If the controller 400 determines that the user has chosen not to perform the basis weight determination (Step S13; NO), the controller 400 ends the basis weight determination control process.

If the controller 400 determines that the user has chosen to perform the basis weight determination (Step S13; YES), the controller 400 performs a basis weight determination process (Step S14).

The basis weight determination process performed in Step S14 is the same as that performed in Step S4 shown in FIG. 8, which is described above, and hence the description is not repeated here.

When ending the basis weight determination process, the controller 400 ends the basis weight determination control process.

[When Tray Setting about Tray has been Changed]

Figure 13:
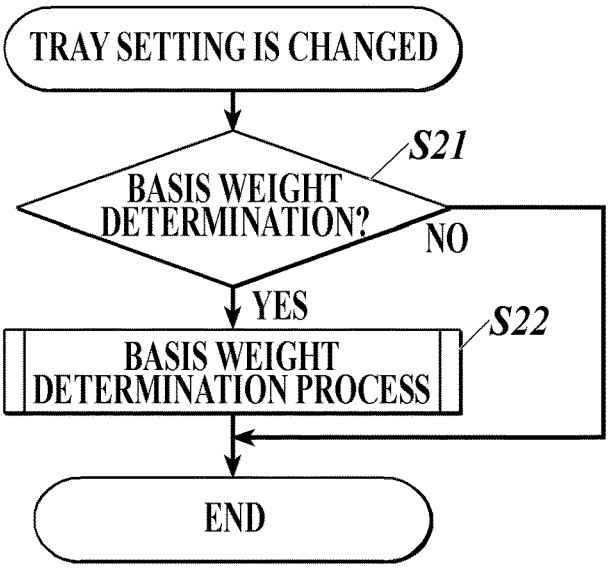
FIG. 13 is a flowchart showing a basis weight determination control process performed by the controller shown in FIG. 2 when a tray setting has been changed.

FIG. 12 is a flowchart showing a basis weight determination control process performed by the controller 400 when the tray setting about any of the trays of the paper feeder 500 has been changed with the operation display unit 420. The process shown in FIG. 13 is performed by the CPU 401 and the program(s) stored in the ROM 402 of the controller 400 working together.

First, the controller 400 causes the operation display unit 420 to display a choice screen for the user to choose whether or not to perform the basis weight determination, and determines whether or not the user has chosen to perform the basis weight determination (Step S21).

If the controller 400 determines that the user has chosen not to perform the basis weight determination (Step S21; NO), the controller 400 ends the basis weight determination control process.

If the controller 400 determines that the user has chosen to perform the basis weight determination (Step S21; YES), the controller 400 performs a basis weight determination process (Step S22).

The basis weight determination process performed in Step S22 is the same as that performed in Step S4 shown in FIG. 8, which is described above, and hence the description is not repeated here. The tray about which the basis weight is determined is the tray about which the tray setting has been changed.

When ending the basis weight determination process, the controller 400 ends the basis weight determination control process.

[When Paper Feeding is about to Start]

The controller 400 performs a basis weight determination control process when paper feeding is about to start. The process performed here is the same as that shown in FIG. 13, which is described above, and hence the description is not repeated here. The tray about which the basis weight is determined is the tray from which paper feeding is about to start.

[When User Instruction has been Made]

When the user has made an instruction to perform the basis weight determination with the operation display unit 420, the controller 400 performs a basis weight determination process. The process performed here is the same as that performed in Step S4 shown in FIG. 8, which is described above, and hence the description is not repeated here.

During execution of a job, the controller 400 performs transfer control, fixation control, and paper conveyance control based on the basis weight included in the tray setting, which is stored in the storage 410, about a tray used for the job. In order to feed (send) the paper P stored in the tray of the paper feeder 500 (to the body 100*a*) for printing the job, the controller 400 sets the air amount larger than the air amount for floating for sufficient sheet separation and floating, and thereafter causes the paper feeder 500 to feed the paper P.

As described above, each tray (each of the first tray 50*a* to the third tray 50*c*) of the paper feeder 500 includes: the side-end air blowers 53, 54 that blow air to sheets of the paper P loaded in the tray to float the sheet(s) of the paper P; and the floating detection sensor 572 that is provided above the sheets of the paper P loaded in the tray and detects the floating of the sheet(s) of the paper P to a predetermined level, and the controller 400 causes the side-end air blowers 53, 54 to blow air and determines the basis weight of the sheets of the paper P loaded in the tray from an air amount that has caused the floating detection sensor 572 to detect the floating of the sheet(s) of the paper P.

This enables the paper feeder 500 using air blowing to determine the basis weight of sheets of paper loaded in each tray without an ultrasound sensor or a weight sensor.

Furthermore, for example, when power has been turned on; when any of the first tray 50*a* to the third tray 50*c* has been opened and closed; when the paper setting about any of the first tray 50*a* to the third tray 50*c* has been changed; and/or when paper feeding is about to start, the controller 400 performs the basis weight determination process that includes causing the side-end air blowers 53, 54 to blow air and determining the basis weight of the sheets of the paper P loaded in the tray. This enables automatic determination of the basis weight of sheets of paper when the power has been turned on, when a tray has been opened and closed, when the paper setting about a tray has been changed, and/or when paper feeding is about to start.

Furthermore, for example, when the power has been turned on, the controller 400 performs control to perform the basis weight determination process in response to the current loaded paper amount in a tray being different from the previous loaded paper amount in the tray the last time the power has been turned off, and not to perform the basis weight determination process in response to the current loaded paper amount being not different from the previous loaded paper amount. Thus, the basis weight determination process is not performed if there is no possibility of change in sheets of paper loaded in a tray during power-off. This prevents the basis weight determination process from being performed unnecessarily.

Furthermore, for example, when a tray has been opened and closed, the controller 400 performs control to perform the basis weight determination process in response to the before opening/closing loaded paper amount in the tray before the tray has been opened and closed being different from the after opening/closing loaded paper amount in the tray after the tray has been opened and closed, and not to perform the basis weight determination process in response to the before opening/closing loaded paper amount being not different from the after opening/closing loaded paper amount. Thus, the basis weight determination process is not performed if there is no possibility of change in sheets of paper loaded in a tray between before and after the tray has been opened and closed. This prevents the basis weight determination process from being performed unnecessarily.

Furthermore, for example, in accordance with a user operation, the controller 400 performs the basis weight determination process that includes causing the side-end air blowers 53, 54 to blow air and determining the basis weight of the sheets of the paper P loaded in a tray. This enables determination of the basis weight of sheets of paper loaded in a tray of the paper feeder 500 at user's desired timing.

Furthermore, for example, before causing the side-end air blowers 53, 54 to blow air for determining the basis weight, the controller 400 causes the side-end air blowers 53, 54 to blow air with an air amount larger than a preset threshold to separate the sheets of the paper P loaded in a tray. This can separate sheets of paper from one another and float the sheets, and consequently prevents accuracy of determination of the basis weight from decreasing, which is caused by the sheets sticking to one another, and accordingly enables determination of the basis weight with high accuracy.

Furthermore, for example, in accordance with the size of the sheets of the paper P loaded in a tray, the controller 400 changes a value of the basis weight corresponding to the air amount having caused the floating detection sensor 572 to detect floating of the sheet(s) of the paper P. This enables determination of the basis weight with high accuracy.

Furthermore, for example, the controller 400 performs control to output a warning of unavailability of paper feeding in response to the air amount having caused the floating detection sensor 572 to detect floating of the sheet(s) of the paper P being smaller than a preset lower limit or larger than a preset upper limit. This enables output of a warning(s) when sheet(s) of paper having the basis weight that makes paper feeding unavailable are set in a tray.

Furthermore, for example, the controller 400 corrects the determined basis weight on the basis of the curl direction and the curl amount detected by the curl detection sensor 573 in response to the determined basis weight exceeding a preset threshold. This enhances accuracy of determination of the basis weight of thick paper, floating of which is affected by its curl.

The above embodiment is merely one of preferred examples of the present invention, and hence not intended to limit the present invention.

For example, although in the above embodiment, the paper feeder 500 and the controller 400 of the image forming apparatus 100 constitute the paper feeding apparatus, the paper feeder 500 may include: a controller including a CPU, a ROM, and a RAM; a storage that stores the basis weight determination table 411 and the basis weight correction table 412; and an output unit (e.g. a display and/or a sound output unit) that outputs the warning, and constitute the paper feeding apparatus. The controller of thus-configured paper feeder 500 may perform the basis weight determination process shown in FIG. 9 when the controller is informed by the image forming apparatus 100 that the power has been turned on, a tray has been opened and closed, the tray setting about a tray has been changed, paper feeding is about to start, an instruction to determine the basis weight has been made by a user operation, and/or the like.

Furthermore, although in the above embodiment, the side-end air blowers 53, 54 blow air to float the sheet(s) of the paper P, the front-end air blower 52 may blow air to float the sheet(s) of the paper P.

Furthermore, although in the above embodiment, the user chooses whether or not to perform the basis weight determination process if the condition(s) to perform the process is satisfied, the basis weight determination process may be performed automatically without the user making a choice if the condition(s) is satisfied.

Furthermore, although in the above embodiment, as the image forming apparatus 100, an image forming apparatus that transfers images directly from a photoreceptor to sheets of paper with a transfer device is cited, the paper feeding apparatus disclosed herein is also applicable to an image forming apparatus that first transfers images formed on a photoreceptor(s) to an intermediate transfer roller, and second transfers the images from the intermediate transfer roller to sheets of paper with a second transfer device.

Furthermore, although in the above embodiment, as the image forming apparatus 100, an electrophotographic image forming apparatus is cited, the paper feeding apparatus disclosed herein is also applicable to an inkjet image forming apparatus.

Furthermore, although in the above description, a non-volatile memory, a hard disk, and so forth are disclosed as examples of a computer-readable storage medium storing the programs disclosed herein, the computer-readable storage medium is not limited to these. As the computer-readable storage medium, a portable storage medium, such as a CD-ROM, may also be used. Also, as a medium that provides, via a communication line, data of the programs disclosed herein, a carrier wave may be used.

The detailed configuration and detailed operation of each apparatus, unit, or the like of the image forming apparatus can be appropriately modified without departing from the scope of the present invention.

Although some embodiments of the present invention have been described and shown in detail, the disclosed embodiments are made for purposes of illustration and example only and not limitation. The scope of the present invention should be interpreted by terms of the appended claims.

The entire disclosure of Japanese Patent Application No. 2018-141071 filed on Jul. 27, 2018 is incorporated herein by reference in its entirety.

What is claimed is:

1. A paper feeding apparatus comprising:

a tray where a sheet of paper is loaded;

an air blower that blows air to the sheet loaded in the tray to float the sheet;

a floating detector that is provided above the sheet loaded in the tray and detects the floating of the sheet to a predetermined level; and a hardware processor that causes the air blower to blow the air and determines a basis weight of the sheet loaded in the tray from an air amount that has caused the floating detector to detect the floating of the sheet, wherein the hardware processor determines the basis weight of the sheet loaded in the tray from the air amount having caused the floating detector to detect the floating of the sheet by referring to information that is stored in a storage and indicates a correspondence relationship between an air amount of the air blower and a basis weight of a sheet of paper, the air amount causing the floating detector to detect floating of the sheet.

2. The paper feeding apparatus according to claim 1, wherein the floating detector includes: a body that swings by contact with the sheet that has been floated to the predetermined level; and an optical sensor that detects the swing of the body.

3. The paper feeding apparatus according to claim 1, wherein the floating detector includes an optical sensor that measures a distance to the sheet loaded in the tray.

4. The paper feeding apparatus according to claim 1, wherein when power of the paper feeding apparatus has been turned on; when the tray has been opened and closed; when a paper setting about the tray has been changed; and/or when paper feeding from the tray is about to start, the hardware processor performs a basis weight determination process that includes causing the air blower to blow the air and determining the basis weight of the sheet loaded in the tray.

5. A paper feeding apparatus comprising:

a tray where a sheet of paper is loaded;

an air blower that blows air to the sheet loaded in the tray to float the sheet;

a floating detector that is provided above the sheet loaded in the tray and detects the floating of the sheet to a predetermined level; and a hardware processor that causes the air blower to blow the air and determines a basis weight of the sheet loaded in the tray from an air amount that has caused the floating detector to detect the floating of the sheet, wherein when power of the paper feeding apparatus has been turned on; when the tray has been opened and closed; when a paper setting about the tray has been changed; and/or when paper feeding from the tray is about to start, the hardware processor performs a basis weight determination process that includes causing the air blower to blow the air and determining the basis weight of the sheet loaded in the tray, and wherein when the power of the paper feeding apparatus has been turned on, the hardware processor performs control to perform the basis weight determination process in response to a current loaded paper amount in the tray being different from a previous loaded paper amount in the tray last time the power has been turned off, and not to perform the basis weight determination process in response to the current loaded paper amount being not different from the previous loaded paper amount.

6. A paper feeding apparatus comprising:

a tray where a sheet of paper is loaded;

an air blower that blows air to the sheet loaded in the tray to float the sheet;

a floating detector that is provided above the sheet loaded in the tray and detects the floating of the sheet to a predetermined level; and a hardware processor that causes the air blower to blow the air and determines a basis weight of the sheet loaded in the tray from an air amount that has caused the floating detector to detect the floating of the sheet, wherein when power of the paper feeding apparatus has been turned on; when the tray has been opened and closed; when a paper setting about the tray has been changed; and/or when paper feeding from the tray is about to start, the hardware processor performs a basis weight determination process that includes causing the air blower to blow the air and determining the basis weight of the sheet loaded in the tray, and wherein when the tray has been opened and closed, the hardware processor performs control to perform the basis weight determination process in response to a before opening/closing loaded paper amount in the tray before the tray has been opened and closed being different from an after opening/closing loaded paper amount in the tray after the tray has been opened and closed, and not to perform the basis weight determination process in response to the before opening/closing loaded paper amount being not different from the after opening/closing loaded paper amount.

7. The paper feeding apparatus according to claim 1, wherein in accordance with a user operation, the hardware processor performs a basis weight determination process that includes causing the air blower to blow the air and determining the basis weight of the sheet loaded in the tray.

8. The paper feeding apparatus according to claim 1, wherein before causing the air blower to blow the air for determining the basis weight, the hardware processor causes the air blower to blow the air with an air amount larger than a preset threshold to separate sheets of the paper loaded in the tray, the sheets including the sheet.

9. The paper feeding apparatus according to claim 1, wherein in accordance with a size of the sheet loaded in the tray, the hardware processor changes a value of the basis weight corresponding to the air amount having caused the floating detector to detect the floating.

10. A paper feeding apparatus comprising:

a tray where a sheet of paper is loaded;

an air blower that blows air to the sheet loaded in the tray to float the sheet;

a floating detector that is provided above the sheet loaded in the tray and detects the floating of the sheet to a predetermined level; and a hardware processor that causes the air blower to blow the air and determines a basis weight of the sheet loaded in the tray from an air amount that has caused the floating detector to detect the floating of the sheet, wherein the hardware processor performs control to output a warning of unavailability of paper feeding in response to the air amount having caused the floating detector to detect the floating being smaller than a preset lower limit or larger than a preset upper limit.

11. A paper feeding apparatus comprising:

a tray where a sheet of paper is loaded;

an air blower that blows air to the sheet loaded in the tray to float the sheet;

a floating detector that is provided above the sheet loaded in the tray and detects the floating of the sheet to a predetermined level;

a hardware processor that causes the air blower to blow the air and determines a basis weight of the sheet loaded in the tray from an air amount that has caused the floating detector to detect the floating of the sheet; and a curl detector that detects a curl direction and a curl amount of the sheet loaded in the tray, wherein the hardware processor corrects the determined basis weight based on the curl direction and the curl amount detected by the curl detector in response to the determined basis weight exceeding a preset threshold.

12. The paper feeding apparatus according to claim 11, wherein the curl detector measures levels of a central part and an end part of the sheet loaded in the tray before the air blower blows the air, the end part being close to an air outlet of the air blower, and detects the curl direction and the curl amount based on a difference between the levels.

13. An image forming apparatus comprising the paper feeding apparatus according to claim 1.

* * * * *